US012070652B2

(12) United States Patent
Contessa

(10) Patent No.: US 12,070,652 B2
(45) Date of Patent: Aug. 27, 2024

(54) FOLDABLE HACK SQUAT AND LEG PRESS MACHINE AND METHOD OF OPERATING THE SAME

(71) Applicant: Christopher Contessa, Houston, TX (US)

(72) Inventor: Christopher Contessa, Houston, TX (US)

( * ) Notice: Subject to any disclaimer, the term of this patent is extended or adjusted under 35 U.S.C. 154(b) by 0 days.

(21) Appl. No.: 18/610,091

(22) Filed: Mar. 19, 2024

(65) Prior Publication Data

US 2024/0226653 A1 Jul. 11, 2024

(51) Int. Cl.
*A63B 23/04* (2006.01)

(52) U.S. Cl.
CPC ... *A63B 23/0405* (2013.01); *A63B 2023/0411* (2013.01); *A63B 2208/0233* (2013.01); *A63B 2210/50* (2013.01)

(58) Field of Classification Search
CPC ..... A63B 23/0405; A63B 2023/0411; A63B 2208/0233; A63B 2210/50
See application file for complete search history.

(56) References Cited

U.S. PATENT DOCUMENTS 4,333,644 A * 6/1982 Lambert, Jr. ..... A63B 21/155 482/135
4,535,985 A * 8/1985 Mask ..... A63B 21/4029 482/138
5,263,913 A * 11/1993 Boren ..... A63B 21/068 482/145
5,810,698 A * 9/1998 Hullett ..... A63B 21/4033 482/134
5,827,154 A * 10/1998 Gill ..... A63B 21/0628 482/135
5,964,684 A * 10/1999 Sokol ..... A63B 21/4047 482/130
7,115,080 B2 * 10/2006 Cockrill, Jr. ..... A63B 21/0626 482/138
7,125,370 B1 * 10/2006 Schaffner ..... A63B 21/155 482/148
7,874,971 B2 * 1/2011 Reyes ..... A63B 21/4005 482/133
10,350,127 B2 * 7/2019 Kelly ..... A63B 23/04
D1,018,725 S * 3/2024 Tong ..... D21/676
2004/0023760 A1 * 2/2004 Cockrill, Jr. ..... A63B 23/0405 482/93
2019/0070449 A1 * 3/2019 Naidus ..... A63B 23/0417

* cited by examiner

*Primary Examiner* — Joshua Lee
(74) *Attorney, Agent, or Firm* — Novel Patent Services

(57) ABSTRACT

A foldable hack squat and leg press machine that enables a user or person to perform hack squat and leg press exercises. The foldable hack squat and leg press machine comprises an elongated frame, a shoulder engagement unit, a weight sled, a foot plate and a foldable support unit. In specific, the shoulder engagement unit comprises a supporting structure, a backrest member and a cushion pad. The foldable support unit comprises a supporting column and one or more supporting struts. The foldable hack squat and leg press machine is adjusted at multiple angles for accommodating users of varying heights and preferences while performing the hack squat and leg press exercises. The foldable hack squat and leg press machine allows the user to vertically fold into a compact form for storage when not in use and easily move the foldable hack squat and leg press machine from one place to other.

23 Claims, 9 Drawing Sheets

FOLDABLE HACK SQUAT AND LEG PRESS MACHINE AND METHOD OF OPERATING THE SAME

FIELD OF THE INVENTION

The present disclosure relates generally to inclined exercise equipment, and more particularly to a foldable hack squat and leg press machine that enables a user or person to perform hack squat and leg press exercises, and adaptable to vertically fold into a compact form for storage when not in use.

BACKGROUND

In recent years, there has been a tremendous increase in the number of persons interested in physical fitness in general, and in particular those involved in various types of exercise. Many people use various types of exercise equipment to strengthen body parts. This exercise equipment enable a user to increase strength, endurance and balance, burn calories, increase muscle mass, improve agility and coordination, and increase overall performance in a sport or other task.

Many individuals struggle to find enough time in their schedules for a complete workout at a health club or gym and they can perform different exercises at home in their free time. However, exercise equipment such as hack squat and leg press machines are bulky devices that take up a lot of floor space in gyms as well as in homes. Furthermore, the exercise equipment may necessitate permanent installation. For installing the exercise equipment, technicians and special tools are required, which adds additional cost to the users or individuals. In addition, the exercise equipment are also difficult to disassemble and require more space for storage even when not in use.

Specialized exercise and fitness equipment and machines are often designed to concentrate resistance forces on certain muscle areas of the user. Exercise equipment and other fitness equipment are frequently built to accommodate more than one sort of exercise. Such combination designs are more resource-efficient than single-exercise machines, both in terms of cost and space. Cost savings are obtained when one machine or piece of equipment can provide many workouts rather than several machines or pieces of equipment each delivering only one of the physical activities.

Combination exercise machines take less room than several exercise machines to do the same workouts, resulting in more efficient accommodation. However, combination fitness equipment or exercise machines are sometimes difficult to reconfigure, necessitating real dismantling or physical separation and movement of individual sections or portions of the equipment or machine. Such issues have previously been the norm when seeking to give exercises with an angled weight sled.

In existing technology, a collapsible seat for a combination hack squat and leg press machine is known. A hack squat platform is operably mounted to a frame for performing a hack squat exercise. A collapsible seat is operably connected to either the frame or the hack squat platform for use in performing a leg press exercise. The collapsible seat and the hack squat platform are provided as alternative configurations whereby only one of either the collapsible seats or the hack squat platform can be used by the individual at one time. However, here the exercise machine utilizes more space, which is difficult to the user to be positioned in their residence or a gym.

Therefore, there is a need for a foldable hack squat and leg press machine that utilizes less space to be positioned in their residence or a gym. There is also a need for a foldable hack squat and leg press machine that is easily foldable to a size that allows to easily storage and is easily unfolded into a useable state that allows for exercising multiple muscle groups. There is also a need for a foldable hack squat and leg press machine that is folded vertically when not in use, thereby reducing the amount of floor space required to store the unit and creates more space in the room. There is also a need for a foldable hack squat and leg press machine that enables the user to position it at multiple angles based on user requirements for performing the hack squat and leg press exercises. Further, there is also a need for a foldable hack squat and leg press machine that can be folded vertically to reduce its footprint.

SUMMARY OF THE INVENTION

The following presents a simplified summary of one or more embodiments of the present disclosure in order to provide a basic understanding of such embodiments. This summary is not an extensive overview of all contemplated embodiments and is intended to neither identify key nor critical elements of all embodiments, nor delineate the scope of any or all embodiments.

The present disclosure, in one or more embodiments, relates to a foldable hack squat and leg press machine that enables a user or person to perform hack squat and leg press exercises. Furthermore, the foldable hack squat and leg press machine is folded vertically to reduce its footprint when not in use. The foldable hack squat and leg press machine comprises an elongated frame, a shoulder engagement unit, a weight sled, a foot plate and a foldable support unit. The foldable hack squat and leg press machine allows the user to vertically fold into a compact form for storage when not in use and easily move the foldable hack squat and leg press machine from one place to other.

In one embodiment herein, the shoulder engagement unit is movably affixed to the elongated frame through one or more hydraulic actuators. The shoulder engagement unit comprises a supporting structure, a backrest member and a cushion pad. The hydraulic actuators are operably connected to side portions of the elongated frame to ensure proper movement for the shoulder engagement unit. In specific, the elongated frame is prepared by a durable material of at least one of steel and aluminum.

In one embodiment herein, the supporting structure having a pair of shoulder rests with handles is configured to affix to the one or more hydraulic actuators through support brackets. In one embodiment herein, the backrest member is pivotally affixed to one end of the supporting structure. The backrest member is configured to enable a user to move between fold and unfold positions during performing hack squat and leg press exercises. The backrest member is configured to enable the user to move from the folded position to the unfolded position and lock the backrest member in the unfolded position while performing the leg press exercise.

In one embodiment herein, the cushion pad is removably positioned on the backrest member and the supporting structure. The cushion pad is adapted to support user's back during performing the hack squat exercise. In one embodiment herein, the weight sled is affixed to one end of the supporting structure. The weight sled is configured to allow the user to add one or more weights on a shaft member.

In one embodiment herein, the foot plate is adjustably affixed to an end portion of the elongated frame through supporting members for accommodating users of varying heights and preferences. The foot plate is configured to allow the user to stand on during performing the hack squat exercise. In specific, each supporting member of the foot plate comprises a pair of slidable tubes that are pivotally affixed to the foot plate to provide support to the foot plate in an inclined position.

The pair of slidable tubes of each supporting member is adjustably connected through a locking pin. The foot plate is further configured to allow the user to detachably position the cushion pad onto it while performing the leg press exercise. The foot plate enables the user to detachably position the cushion pad using one or more fasteners for performing leg press exercise. In specific, the fasteners include at least one of magnets, screws, bolts, nuts, and pins.

In one embodiment herein, the foldable support unit is configured to support the elongated frame. The foldable support unit is configured to enable the user to fold the foldable hack squat and leg press machine into a closed position when not in use. The foldable support unit comprises a supporting column and one or more supporting struts.

In one embodiment herein, the supporting column is pivotally connected to the elongated frame through a hinge member. The supporting column is configured to adjustably and securely support the elongated frame in an inclined position. In specific, the supporting column of the foldable support unit comprises at least two slidable shafts, which are locked at a required position using a locking member to adjust and securely support the elongated frame. The supporting column is a telescopic shaft for adjusting supporting the elongated frame in the inclined position.

In one embodiment herein, the one or more supporting struts are pivotally connected between the supporting column and the elongated frame. The one or more supporting struts are configured to provide support to the supporting column for holding the elongated frame in a position. The one or more supporting struts include at least one of a gas strut, a gas spring, a gas piston and gas rams.

In one embodiment herein, the foldable hack squat and leg press machine is configured to support on one or more heavy-duty wheels, which are affixed to a bottom portion of the elongated frame, thereby allowing the user to easily move the foldable hack squat and leg press machine from one place to other. The one or more heavy-duty wheels are locked by brake members. The one or more heavy-duty wheels are configured to move in upward direction from a floor surface using a small pedal while performing the hack squat and leg press exercises, thereby allowing the lower portion of the elongated frame to rest or support on the floor surface. In one embodiment herein, the foldable hack squat and leg press machine comprises a pair of holders that are configured to enable the user to hold during performing leg press exercises.

In one embodiment herein, the foldable hack squat and leg press machine is adjusted to multiple angles for accommodating users of varying heights and preferences while performing the hack squat and leg press exercises. The user is enabled to perform the hack squat and leg press exercises without and with one or more weights that are positioned on the shaft member of the weight sled.

In one embodiment herein, a method of operating the foldable hack squat and leg press machine is disclosed. In one embodiment herein, the method comprises the steps of: at one step, the user places the foldable hack squat and leg press machine by unfolding the supporting column of the foldable support unit. At one step, the user adjusts the supporting column to at least one selected angle of multiple angles and securely positions the elongated frame. At one step, the user positions the foot plate at an end portion of the elongated frame through the supporting members. At one step, the user adjusts the shoulder engagement unit and the weight sled without or with the required weights onto the shaft member of the weight sled, thereby allowing the user to perform the hack squat exercise.

At one step, the user detaches the cushion pad from the backrest member of the shoulder engagement unit and positions the cushion pad onto the foot plate using one or more fasteners. At one step, the user moves the backrest member from the folded position to the unfolded position and lock the backrest member in the unfolded position, thereby allowing the user to perform a leg press exercise. At one step, the user folds the backrest member, the foot plate, and the supporting column of the foldable support unit, thereby allowing the user to fold vertically into a compact form for storage when not in use and easily move the foldable hack squat and leg press machine from one place to other.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

The accompanying drawings, which are incorporated in and constitute a part of the specification, illustrate an embodiment of the invention, and, together with the description, explain the principles of the invention.

DETAILED DESCRIPTION

Figure 1A:
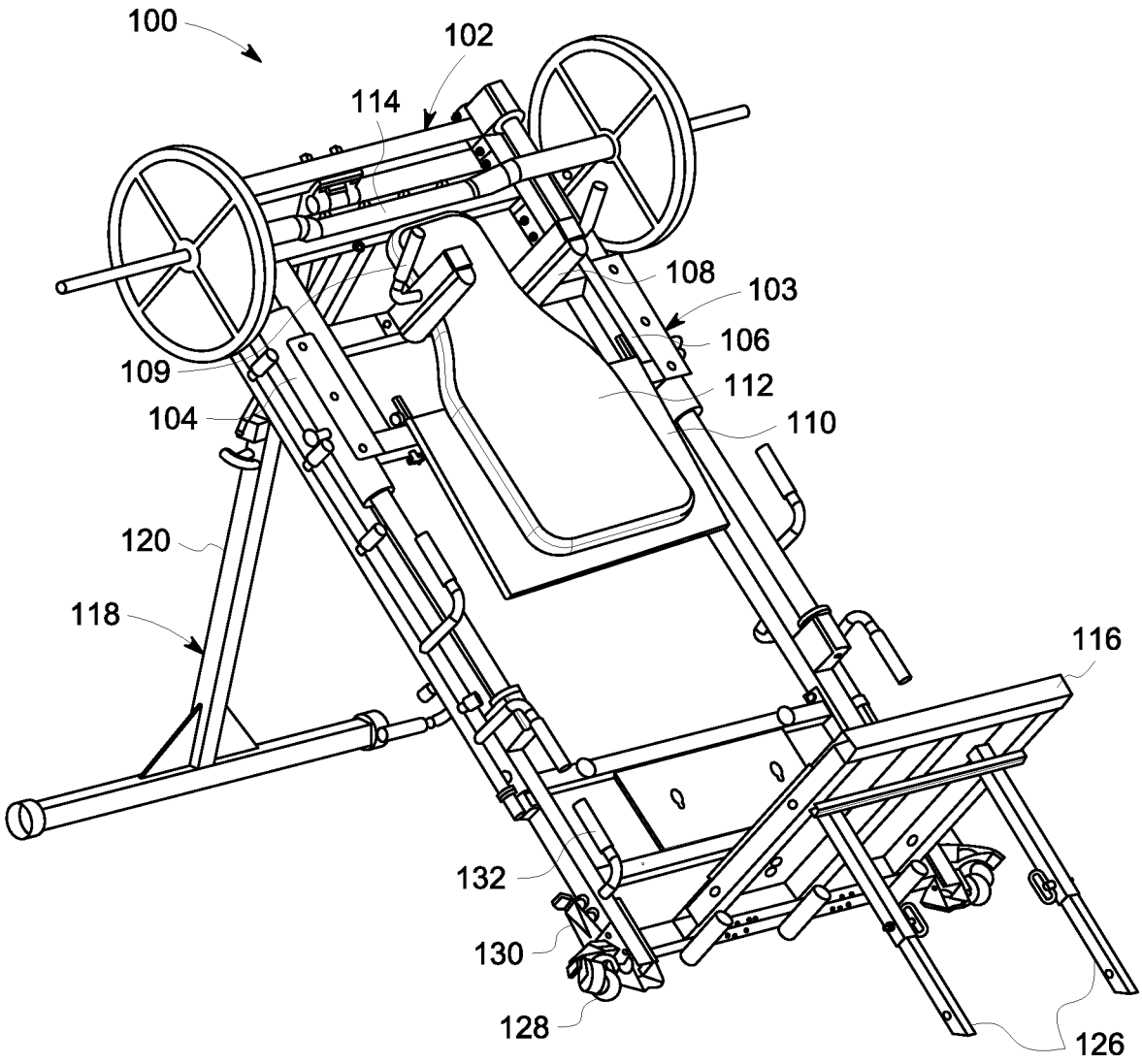
FIG. 1A illustrates an isometric view of a foldable hack squat and leg press machine, in accordance with embodiments of the invention.

Reference will now be made in detail to the present preferred embodiments of the invention, examples of which are illustrated in the accompanying drawings. Wherever possible, the same reference numerals are used in the drawings and the description to refer to the same or like parts.

FIG. 1A refers to an isometric view of a foldable hack squat and leg press machine 100 that enables a user or person to perform hack squat and leg press exercises. Furthermore, the foldable hack squat and leg press machine 100 is folded vertically to reduce its footprint when not in use. The foldable hack squat and leg press machine 100 comprises an elongated frame 102, a shoulder engagement unit 103, a weight sled 114, a foot plate 116 and a foldable support unit 118.

In one embodiment herein, the elongated frame 102 having a rectangular shape structure. The elongated frame 102 is prepared by a durable material of at least one of steel and aluminum. The elongated frame 102 provides stability and safety when performing hack squat and leg press exercises. The elongated frame 102 stores compactly when not in use, thereby making the foldable hack squat and leg press machine 100 suitable for home gyms, fitness studios, and small workout spaces. In one embodiment herein, the foldable hack squat and leg press machine 100 may allow the user to perform a 45-degree leg press and an incline leg press exercises.

In one embodiment herein, the shoulder engagement unit 103 is movably affixed to the elongated frame 102 through one or more hydraulic actuators 104. The shoulder engagement unit 103 comprises a supporting structure 106, a backrest member 110 and a cushion pad 112. The hydraulic actuators 104 are operably connected to side portions of the elongated frame 102 to ensure proper movement for the shoulder engagement unit 103.

In one embodiment herein, the supporting structure 106 having a pair of shoulder rests 108 with handles 109 is configured to affix to the one or more hydraulic actuators 104 through support brackets. In one embodiment herein, the backrest member 110 is pivotally affixed to one end of the supporting structure 106. The backrest member 110 is configured to enable a user to move between fold and unfold positions while performing hack squat and leg press exercises. The backrest member 110 is configured to enable the user to move from the folded position to the unfolded position and lock the backrest member 110 in the unfolded position while performing the leg press exercise.

In one embodiment herein, the cushion pad 112 is removably positioned on the backrest member 110 and the supporting structure 106. The cushion pad 112 is adapted to support the user's back while performing the hack squat exercise. The cushion pad 112 is positioned to the backrest member 110. In one embodiment herein, the cushion pad 112 is made of a material that includes at least one of a foam material, rubber, sponge, resilient fibers, and thereof. In one embodiment herein, the weight sled 114 is affixed to one end of the supporting structure 106. The weight sled 114 is configured to allow the user to add one or more weights on a shaft member.

In one embodiment herein, the foot plate 116 is adjustably affixed to an end portion of the elongated frame 102 through supporting members 126 for accommodating users of varying heights and preferences. The foot plate 116 is configured to allow the user to stand on while performing the hack squat exercise. In specific, each supporting member 126 of the foot plate 116 comprises a pair of slidable tubes that are pivotally affixed to the foot plate 116 to provide support to the foot plate 116 in an inclined position.

The pair of slidable tubes of each supporting member 126 is adjustably connected through a locking pin. The foot plate 116 is further configured to allow the user to detachably position the cushion pad 112 onto it while performing the leg press exercise. The foot plate 116 enables the user to detachably position the cushion pad 112 using one or more fasteners for performing leg press exercise. In one embodiment herein, the fasteners include at least one of magnets, screws, bolts, nuts, pins, and thereof.

In one embodiment herein, the foldable support unit 118 is configured to support the elongated frame 102. The foldable support unit 118 is configured to enable the user to fold the foldable hack squat and leg press machine 100 into a closed position when not in use. The foldable support unit 118 comprises a supporting column 120 and one or more supporting struts 122.

In one embodiment herein, the supporting column 120 is pivotally connected to the elongated frame 102 through a hinge member 124. The supporting column 120 is configured to adjustably and securely support the elongated frame 102 in an inclined position. In specific, the supporting column 120 of the foldable support unit 118 comprises at least two slidable shafts, which are locked at a required position using a locking member to adjust and securely support the elongated frame 102. The supporting column 120 is a telescopic shaft for adjusting supporting the elongated frame 102 in the inclined position.

In one embodiment herein, the supporting struts 122 are pivotally connected between the supporting column 120 and the elongated frame 102. The supporting struts 122 are configured to provide support to the supporting column 120 for holding the elongated frame 102 in a position. The supporting struts 122 include at least one of a gas strut, a gas spring, a gas piston and gas rams.

In one embodiment herein, the foldable hack squat and leg press machine 100 is configured to support on one or more heavy-duty wheels 128, which are affixed to a bottom portion of the elongated frame 102, thereby allowing the user to easily move the foldable hack squat and leg press machine 100 from one place to other. The heavy-duty wheels 128 are locked by using brake members. In one embodiment herein, the one or more heavy-duty wheels 128 are configured to move in an upward direction from a floor surface using a small pedal while performing the hack squat and leg press exercises, thereby allowing the lower portion of the elongated frame 102 to rest or support on the floor surface. The foldable hack squat and leg press machine 100 is stabilized to function like a regular machine without the risk of wheels rolling on the floor surface. The foldable hack squat and leg press machine 100 provides the user with a safe and secure exercise experience, without the need to worry about the foldable hack squat and leg press machine 100 accidentally rolling or shifting during use. The combination of stability and foldability makes the foldable hack squat and leg press machine 100 a versatile and practical fitness option for individuals who want a reliable and space-saving workout machine.

In one embodiment herein, the foldable hack squat and leg press machine 100 comprises a pair of holders 132 that are configured to enable the user to hold while performing leg press exercises. Specifically, the pair of holders 132 can be manufactured by a material that includes, but not limited to, an iron, a steel and other similar materials.

In one embodiment herein, the foldable hack squat and leg press machine 100 comprises ergonomic handles and grips to improve stability and support while performing hack squat and leg press exercises. In one embodiment herein, the foldable hack squat and leg press machine 100 enables the user to adjust the difficulty of exercises by varying the weight to match their fitness level and goals. In specific, the weights include at least one of weight plates, weight stacks and hydraulic cylinders thereof.

In one embodiment herein, the foldable hack squat and leg press machine 100 allows the user to vertically fold into a compact form for storage when not in use and easily move the foldable hack squat and leg press machine 100 from one place to other. The foldable hack squat and leg press machine 100 is configured to adjust at multiple angles for accommodating the users of varying heights and preferences to perform the hack squat and leg press exercises. The user is enabled to perform the hack squat and leg press exercises without and with one or more weights that are positioned on the shaft member of the weight sled 114.

Figure 1B:
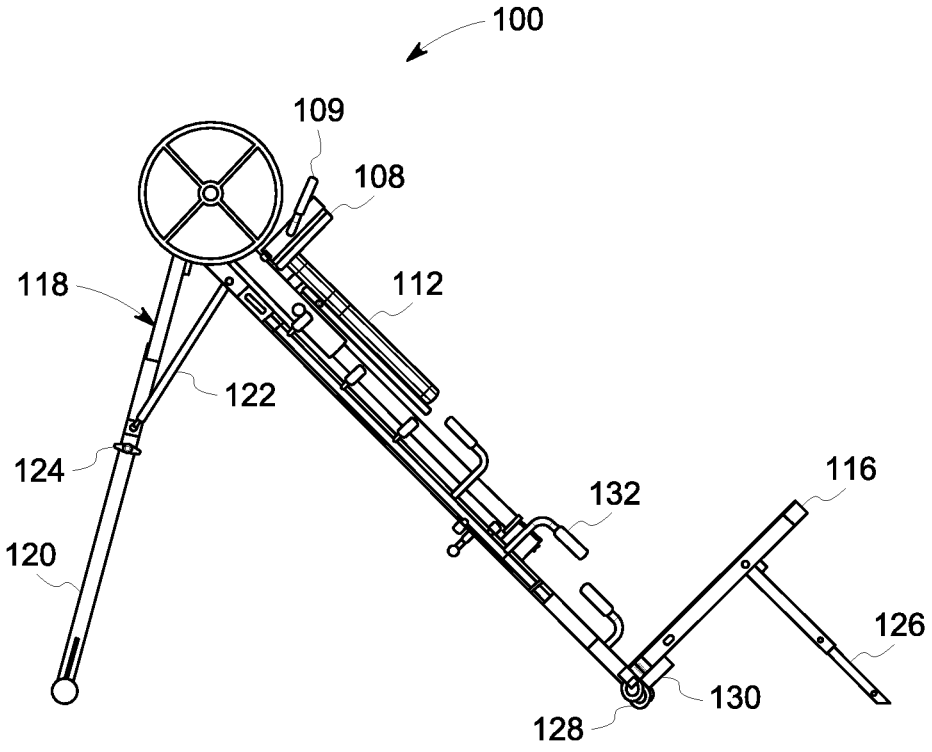
FIG. 1B illustrates a perspective side view of the foldable hack squat and leg press machine at initial position, in accordance with embodiments of the invention.

FIG. 1B refers to a perspective side view of the foldable hack squat and leg press machine 100 at the initial position. In one embodiment herein, the supporting struts 122 are operably connected between the supporting column 120 and the elongated frame 102. The supporting struts 122 are configured to be retracted upward to support the weight of the elongated frame 102 while performing the hack squat and leg press exercises.

The supporting struts 122 are configured to be retracted downward along the supporting column 120 to vertically fold and unfold the foldable hack squat and leg press machine 100 easily. The supporting struts 122 assist the foldable hack squat and leg press machine 100 during folding and unfolding. The supporting column 120 is pivotally connected to the elongated frame 102 through the hinge member 124 for enabling the user to lock the supporting struts 122 for stability while performing hack squat and leg press exercises and to unlock the supporting struts 122 to fold the elongated frame 102 for convenient storage when not in use.

The user may or may not place at least one weight on the shaft member of the weigh sled 114 based on the user's requirement while performing the hack squat and leg press exercises. Next, the user needs to lock the position of the foot plate 116 to stand on while performing the hack squat exercise.

Figure 1C:
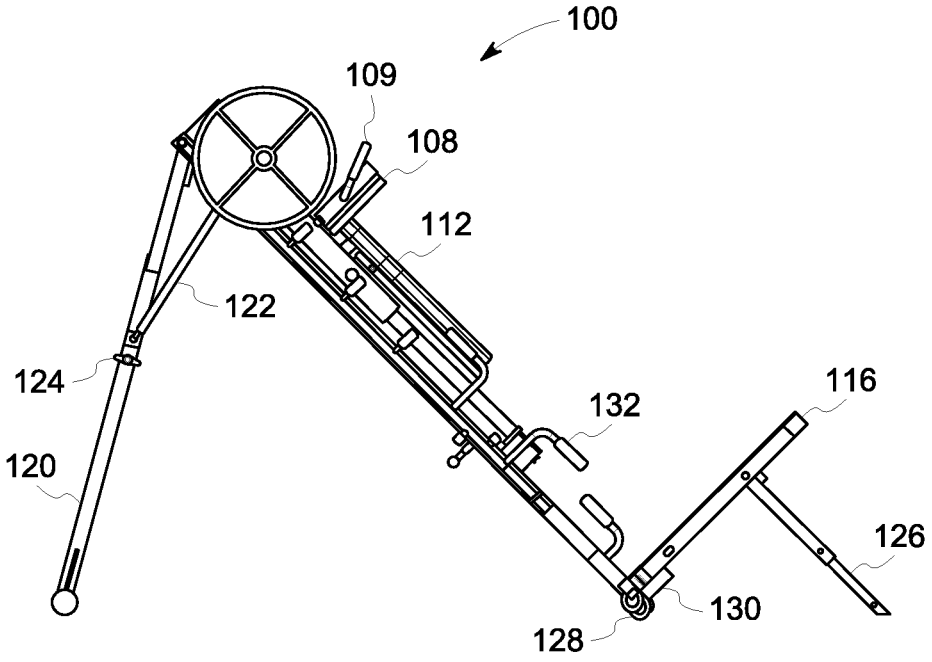
FIG. 1C illustrates a perspective side view of the foldable hack squat and leg press machine at the adjusted position, in accordance with embodiments of the invention.

FIG. 1C refers to a perspective side view of the foldable hack squat and leg press machine 100 at the adjusted position to perform the hack squat exercises. Here, the user sits on the foot plate 116 and places their shoulder below the shoulder rests 108 to perform hack squat exercises.

Figure 2A:
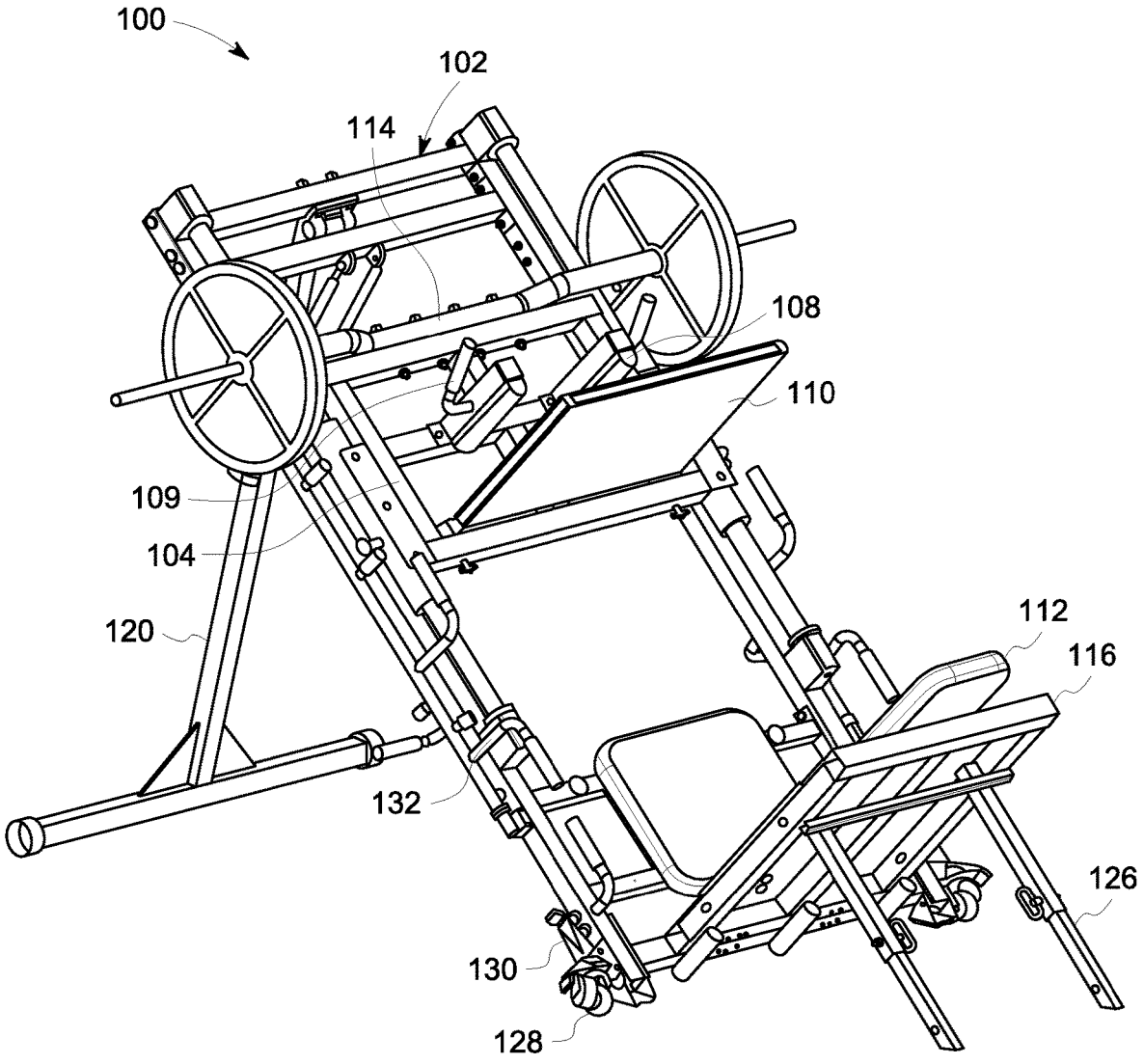
FIG. 2A illustrates an isometric view of the foldable hack squat and leg press machine to perform leg press exercise, in accordance with embodiments of the invention.

FIG. 2A refers to an isometric view of the foldable hack squat and leg press machine 100 to perform leg press exercises. In one embodiment herein, the backrest member 110 enables the user to move from the folded position to the unfolded position and lock the backrest member 110 in the unfolded position while performing the leg press exercise. The foot plate 116 is configured to enable the user to sit inversely to perform leg press exercises. The cushion pad 112 is configured to be detachably positioned to the foot plate 116 while performing leg press exercises using fasteners that include at least one of magnets, screws, bolts, nuts, and pins.

In one embodiment herein, the user removes the cushion pad 112 from the backrest member 110 by removing the fasteners. Next, the user needs to unfold the backrest member 110 in a perpendicular direction to the elongated frame 102, thereby locking the backrest member 110. Later, the user needs to connect the cushion pad 112 to the foot plate 116 by using the fasteners. The space between the backrest member 110 and the foot plate 116 enables the user to sit inversely to perform the leg pressing exercises.

Figure 2B:
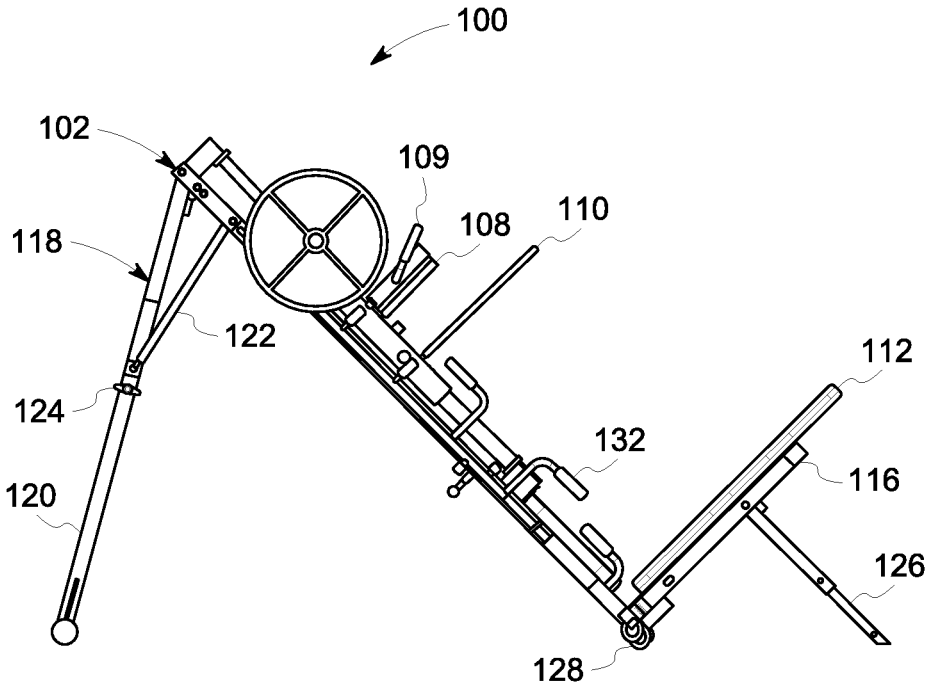
FIG. 2B illustrates a perspective side view of the foldable hack squat and leg press machine at the adjusted position to perform leg press exercise, in accordance with embodiments of the invention.

FIG. 2B refers to a perspective side view of the foldable hack squat and leg press machine 100 at the adjusted position to perform the leg press exercise. In one embodiment herein, at least two supporting members 126 are operably connected to the downwards of the foot plate 116. In specific, the supporting members 126 are extended outside and positioned on the base to support the foldable hack squat and leg press machine 100 while performing hack squat and leg press exercises. The user is enabled to perform the hack squat and leg press exercises without and with one or more weights that are positioned on the shaft member of the weight sled 114 based on the user's requirements so that the supporting structure 106 moves downwards.

The user positions their back against the cushion pad 112, which is positioned on the foot plate 116, and performs the leg press exercises by using their legs to push the backrest member 110, which causes the shoulder engagement unit 103 and the weight sled 114 to move accordingly. The user can control the movement of the shoulder engagement unit 103 to ensure optimal performance and to prevent any risk of injury.

One end of the supporting column 120 of the foldable support unit 118 is positioned on the base and another end of the supporting column 120 is connected to an upper portion of the elongated frame 102 to support while performing the hack squat and leg press exercises. In addition, the supporting struts 122 are pivotally connected between the supporting column 120 and the elongated frame 102. In specific, the supporting struts 122 assist in reducing the tension while performing the hack squat and leg press exercises. The supporting struts 122 assist the foldable hack squat and leg press machine 100 during folding and unfolding operations.

Figure 3A:
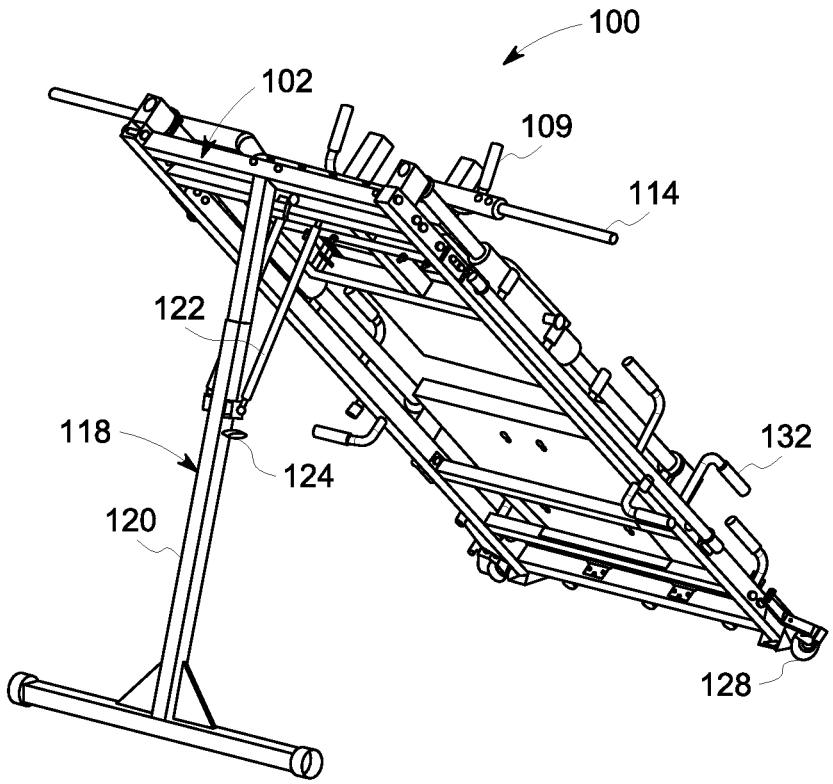
FIGS. 3A-3B illustrate isometric views of the foldable hack squat and leg press machine upon folding except a supporting column, in accordance with embodiments of the invention.
Figure 3B:
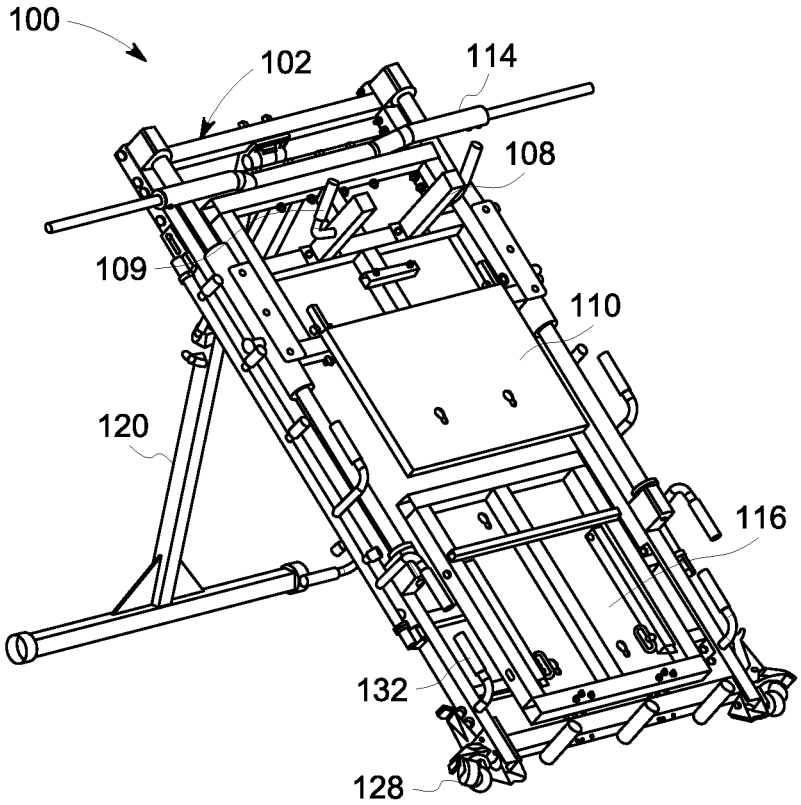

FIGS. 3A-3B refer to isometric views of the foldable hack squat and leg press machine 100 upon folding except the supporting column 120. In one example embodiment herein, the foldable hack squat and leg press machine 100 needs to be folded after performing the hack squat and leg press exercises for compact storage. So, the user needs to remove the weight from the weight sled 114 so that the supporting structure 106 to revert back to the initial position i.e., adjacent to the elongated frame 102. The user folds the foot plate 116 adjacent to the elongated frame 102, thereby folding and locking the supporting members 126 using the locking pin.

Figure 3C:
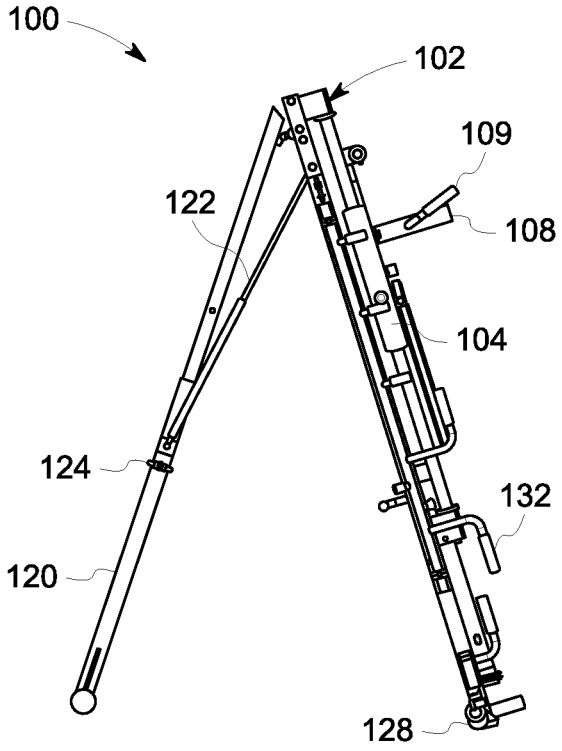
FIG. 3C illustrates a perspective side view of the foldable hack squat and leg press machine upon folding except the supporting column, in accordance with embodiments of the invention.

FIG. 3C refers to a perspective side view of the foldable hack squat and leg press machine 100 upon folding except the supporting column 120. The user needs to unlock the brake members 130 for the movement of the elongated frame 102. The supporting column 120 is extended from the base and is pivotally connected to the upper portion of the elongated frame 102 to support while performing the hack squat and leg press exercises.

The supporting struts 122 are configured to be retracted upward to support the weight of the elongated frame 102 while performing the hack squat and leg press exercises. The supporting struts 122 are configured to be retracted downward along the supporting column 120 to vertically fold and unfold the foldable hack squat and leg press machine 100 easily. The supporting column 120 enables the user to lock the supporting struts 122 for stability while performing the hack squat and leg press exercises using the hinge member 124. The hinge member 124 enables the user to unlock the supporting struts 122 to fold the frame 102 for convenient storage when not in use.

In one embodiment herein, the supporting column 120 is pivotally connected to the elongated frame 102 through the hinge member 124. The supporting column 120 is configured to adjustably and securely support the elongated frame 102 in an inclined position. The supporting struts 122 secures the foldable hack squat and leg press machine 100 in the upright stored position, or in the fully extended exercise position, and several positions in between to provide varied exercise options.

Figure 4A:
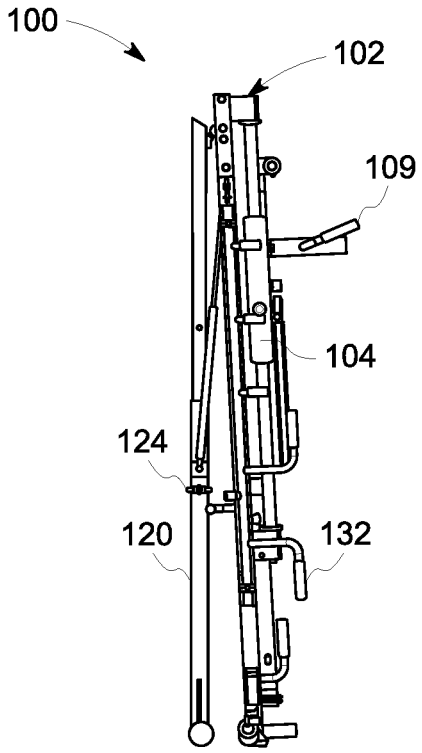
FIG. 4A illustrates a perspective side view of the foldable hack squat and leg press machine upon folding, in accordance with embodiments of the invention.

FIG. 4A refers to a perspective side view of the foldable hack squat and leg press machine 100 upon folding. In one embodiment herein, the user needs to unlock the brake members 130 for the movement of the elongated frame 102. The two heavy-duty wheels 128 are positioned at the lower portion of both ends of the elongated frame 102. The two heavy-duty wheels 128 are configured to enable the user to easily move the foldable hack squat and leg press machine 100 from one place to another. The heavy-duty wheels 128 are locked by the brake members 130 when the foldable hack squat and leg press machine 100 is used by the user for performing the hack squat and leg press exercises. The supporting column 120 and the elongated frame 102 are securely connected by using a steel pin, which is used to hold the foldable hack squat and leg press machine 100 in place, thereby allowing to conveniently fold and store away when not in use.

Figure 4B:
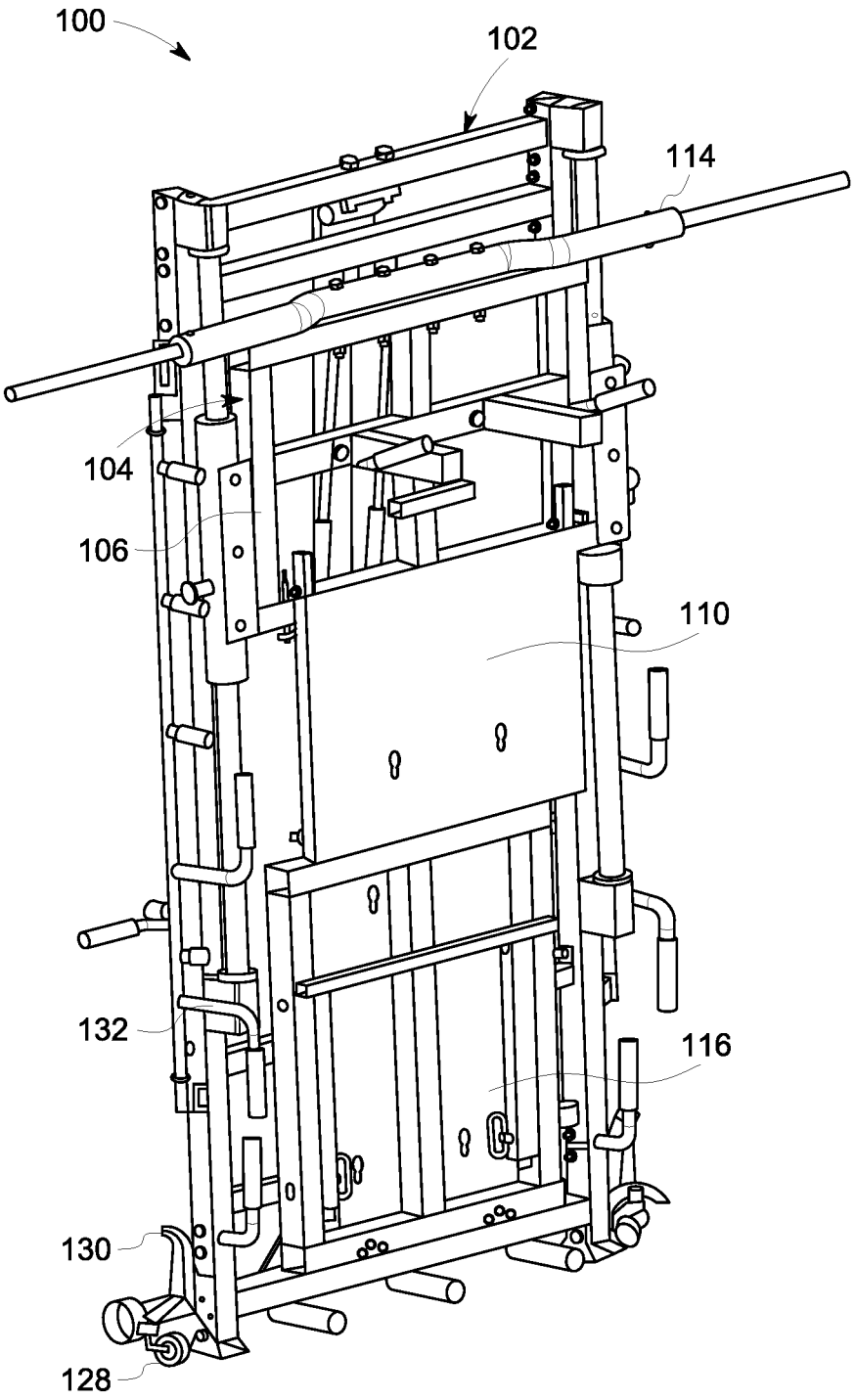
FIG. 4B illustrates an isometric view of the foldable hack squat and leg press machine upon folding, in accordance with embodiments of the invention.
Figure 4C:
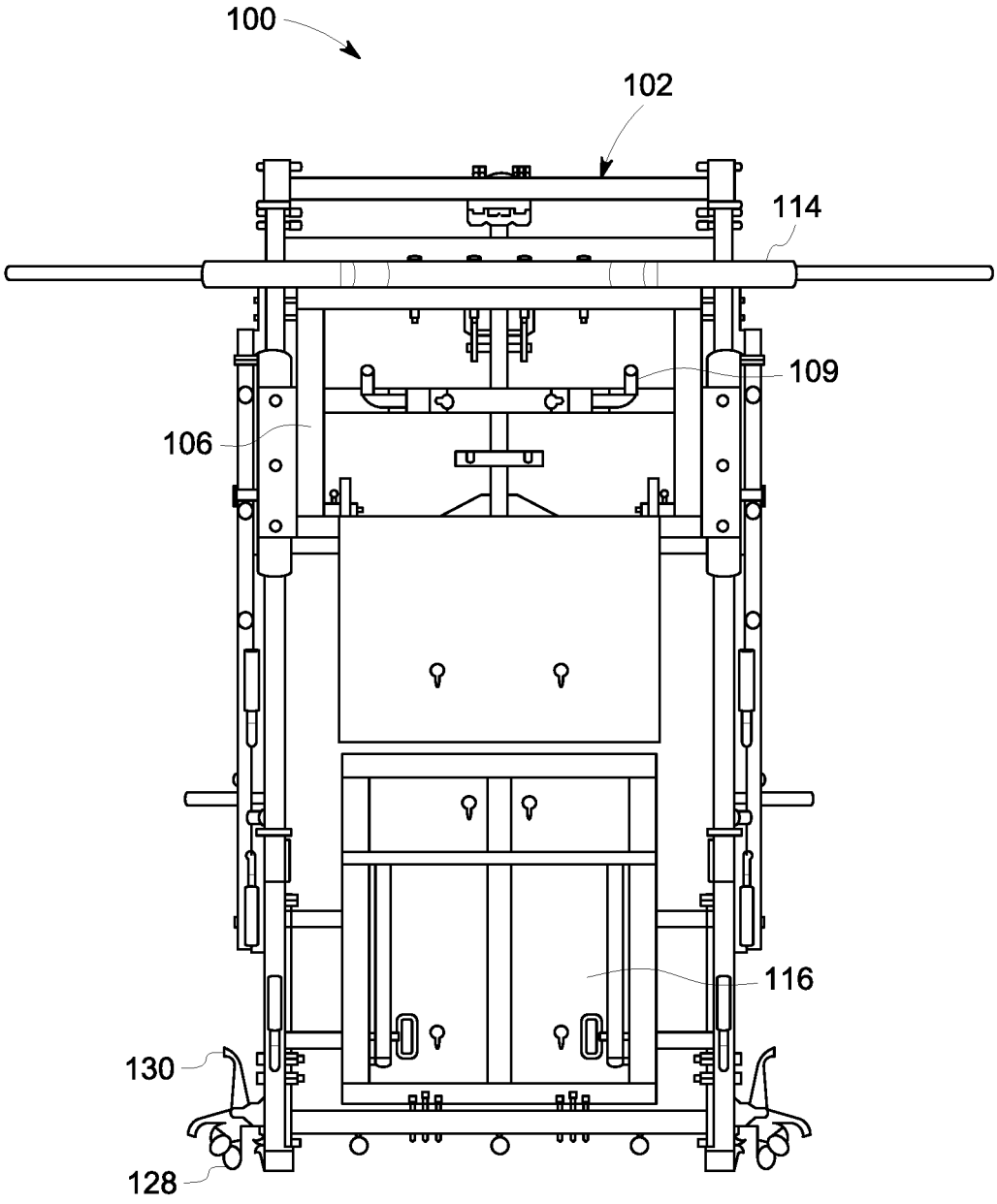
FIG. 4C illustrates a perspective front view of the foldable hack squat and leg press machine upon folding, in accordance with embodiments of the invention.

FIGS. 4B-4C refer to isometric and perspective front views of the foldable hack squat and leg press machine 100 upon folding. In one embodiment herein, the foldable hack squat and leg press machine 100 comprises plurality of bars positioned at the bottom portion of the elongated frame 102 that assist the foldable hack squat and leg press machine 100 to stand on the base. The foldable hack squat and leg press machine 100 takes very minimal floor space to store. The foldable hack squat and leg press machine 100 folds vertically for simple storage and takes up less floor space.

Figure 5:
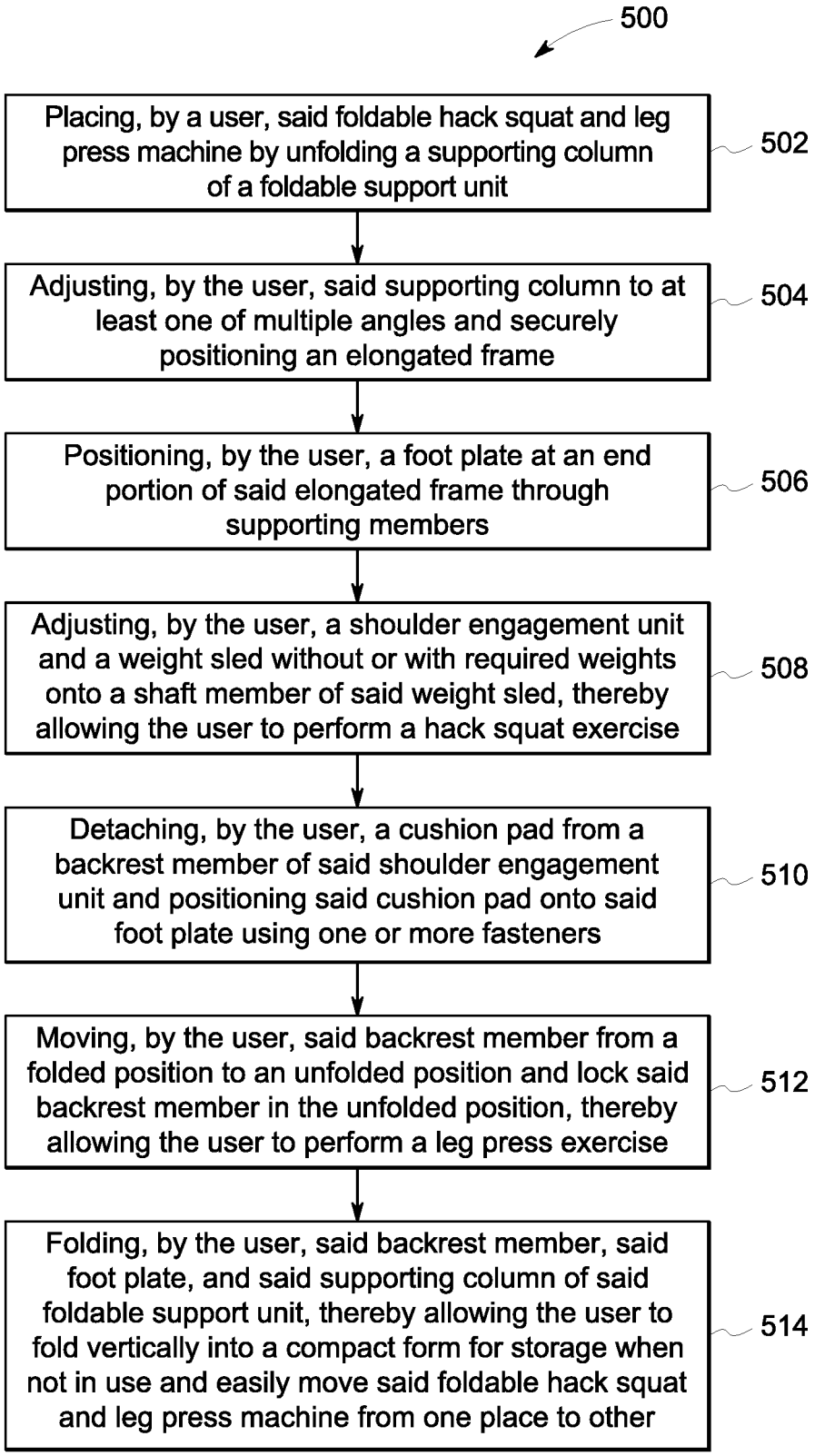
FIG. 5 illustrates a flowchart of a method for operating the foldable hack squat and leg press machine, in accordance with embodiments of the invention.

FIG. 5 refers to a flowchart 500 of a method for operating the foldable hack squat and leg press machine 100. At step 502, the user places the foldable hack squat and leg press machine 100 by unfolding the supporting column 120 of the foldable support unit 118. At step 504, the user adjusts the supporting column 120 to at least one selected angle of multiple angles and securely positions the elongated frame 102. Here, the user can select at least one angle from multiple angles to perform the hack squat and leg press exercises. At step 506, the user positions the foot plate 116 at an end portion of the elongated frame 102 through the supporting members 126.

At step 508, the user adjusts the shoulder engagement unit 103 and the weight sled 114 without or with the required weights onto the shaft member of the weight sled 114, thereby allowing the user to perform the hack squat exercise. At step 510, the user detaches the cushion pad 112 from the backrest member 110 of the shoulder engagement unit 103 and positions the cushion pad 112 onto the foot plate 116 using one or more fasteners.

At step 512, the user moves the backrest member 110 from the folded position to the unfolded position and lock the backrest member 110 in the unfolded position, thereby allowing the user to perform a leg press exercise. At step 514, the user folds the backrest member 110, the foot plate 116, and the supporting column 120 of the foldable support unit 118, thereby allowing the user to fold vertically into a compact form for storage when not in use and easily move the foldable hack squat and leg press machine 100 from one place to other.

In another embodiment herein, the weight sled 114 is removably affixed to the supporting structure 106 of the shoulder engagement unit 103 so that the user can remove the weight sled 114 from the foldable hack squat and leg press machine 100 for performing weight lifting exercise by adding the required weights.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principles of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

It will readily be apparent that numerous modifications and alterations can be made to the processes described in the foregoing examples without departing from the principles underlying the invention, and all such modifications and alterations are intended to be embraced by this application.

The invention claimed is:

1. A foldable hack squat and leg press machine, comprising:

an elongated frame;

a shoulder engagement unit movably affixed to said elongated frame through one or more hydraulic actuators, wherein said shoulder engagement unit comprises:

a supporting structure having a pair of shoulder rests with handles configured to affix to said one or more hydraulic actuators through support brackets;

a backrest member pivotally affixed to one end of said supporting structure, wherein said backrest member is configured to allow a user to move said backrest member between folded and unfolded positions during hack squat and leg press exercises;

a cushion pad removably positioned on said backrest member and said supporting structure, wherein said cushion pad is adapted to support the user's back during the hack squat exercise; and a weight sled affixed to one end of said supporting structure, wherein said weight sled is configured to allow the user to add one or more weights on a shaft member;

a foot plate adjustably affixed to an end portion of said elongated frame through supporting members for accommodating users of varying heights and preferences, wherein said foot plate is configured to allow the user to stand on said foot plate during the hack squat exercise; and a foldable support unit configured to support said elongated frame, wherein said foldable support unit is configured to enable the user to fold said foldable hack squat and leg press machine into a closed position when not in use, wherein said foldable support unit comprises:

a supporting column pivotally connected to said elongated frame through a hinge member, wherein said supporting column is configured to adjustably and securely support said elongated frame in an inclined position; and one or more supporting struts pivotally connected between said supporting column and said elongated frame, wherein said one or more supporting struts are configured to provide support to said supporting column for holding said elongated frame in a position, whereby said foldable hack squat and leg press machine allows the user to vertically fold said foldable hack squat and leg press machine into a compact form for storage when not in use and easily move said foldable hack squat and leg press machine from one place to other.

2. The foldable hack squat and leg press machine of claim 1, wherein said supporting column of said foldable support unit comprises at least two slidable shafts, which are locked at a required position using a locking member to adjust and securely support said elongated frame.

3. The foldable hack squat and leg press machine of claim 1, wherein said supporting column is a telescopic shaft for adjustably supporting said elongated frame in the inclined position.

4. The foldable hack squat and leg press machine of claim 1, wherein said each supporting member of said foot plate comprises a pair of slidable tubes that are pivotally affixed to said foot plate for providing support to said foot plate in an inclined position, wherein said pair of slidable tubes of each supporting member is adjustably connected through a locking pin.

5. The foldable hack squat and leg press machine of claim 1, wherein said one or more supporting struts include at least one of a gas strut, a gas spring, a gas piston and gas rams.

6. The foldable hack squat and leg press machine of claim 1, wherein said backrest member is configured to enable the user to move from the folded position to the unfolded position and lock said backrest member in the unfolded position while performing the leg press exercise.

7. The foldable hack squat and leg press machine of claim 1, wherein said foot plate is further configured to allow the user to detachably position said cushion pad onto it while performing the leg press exercise.

8. The foldable hack squat and leg press machine of claim 1, wherein said cushion pad is detachably positioned to said foot plate using one or more fasteners for performing the leg press exercise, wherein said fasteners include at least one of magnets, screws, bolts, nuts, and pins.

9. The foldable hack squat and leg press machine of claim 1, wherein said foldable hack squat and leg press machine is configured to support one or more heavy-duty wheels, which are affixed to a bottom portion of said elongated frame, thereby allowing the user to easily move said foldable hack squat and leg press machine from one place to other, wherein said one or more heavy-duty wheels are locked by brake members.

10. The foldable hack squat and leg press machine of claim 9, wherein said one or more heavy-duty wheels are configured to move in an upward direction from a floor surface using a small pedal during the hack squat and leg press exercises, thereby allowing the bottom portion of said elongated frame to rest or support on the floor surface.

11. The foldable hack squat and leg press machine of claim 1, wherein said foldable hack squat and leg press machine is configured to be adjusted at multiple angles for accommodating the users of varying heights and preferences during the hack squat and leg press exercises.

12. The foldable hack squat and leg press machine of claim 1, wherein said user is enabled to perform the hack squat and leg press exercises with and without one or more weights that are positioned on said shaft member of said weight sled.

13. The foldable hack squat and leg press machine of claim 1, wherein said one or more hydraulic actuators are operably connected to side portions of said elongated frame to ensure proper movement for said shoulder engagement unit.

14. The foldable hack squat and leg press machine of claim 1, wherein said elongated frame is prepared by a durable material of at least one of steel and aluminum.

15. The foldable hack squat and leg press machine of claim 1, wherein said foldable hack squat and leg press machine further comprises:

a pair of holders configured to enable said user to hold said pair of holders during the leg press exercises.

16. A foldable hack squat and leg press machine, comprising:

an elongated frame;

a shoulder engagement unit movably affixed to said elongated frame through one or more hydraulic actuators, wherein said shoulder engagement unit comprises:

a supporting structure having a pair of shoulder rests with handles configured to affix to said one or more hydraulic actuators through support brackets;

a backrest member pivotally affixed to one end of said supporting structure, wherein said backrest member is configured to allow a user to move between folded and unfolded positions during hack squat and leg press exercises, wherein said backrest member is configured to enable the user to move said backrest member the folded position to the unfolded position and lock said backrest member in the unfolded position during the leg press exercise;

a cushion pad removably positioned on said backrest member and said supporting structure, wherein said cushion pad is adapted to support the user's back during the hack squat exercise; and a weight sled affixed to one end of said supporting structure, wherein said weight sled is configured to allow the user to add one or more weights on a shaft member;

a foot plate adjustably affixed to a bottom portion of said elongated frame through supporting members for accommodating users of varying heights and preferences, wherein said foot plate is configured to allow the user to stand on said foot plate during the hack squat exercise, wherein said foot plate is configured to enable the user to fold said foot plate into the elongated frame when not in use, wherein said foot plate is further configured to allow the user to detachably position said cushion pad onto it during the leg press exercise; and a foldable support unit configured to support said elongated frame, wherein said foldable support unit is configured to enable the user to fold said foldable hack squat and leg press machine into a closed position when not in use, wherein said foldable support unit comprises:

a supporting column pivotally connected to said elongated frame through a hinge member, wherein said supporting column is configured to adjustably and securely support said elongated frame in an inclined position, wherein said supporting column comprises at least two slidable shafts, which are locked at a required position using a locking member to adjust and securely support said elongated frame; and one or more supporting struts pivotally connected between said supporting column and said elongated frame, wherein said one or more supporting struts are configured to provide support to said supporting column for holding said elongated frame in the inclined position.

17. The foldable hack squat and leg press machine of claim 16, wherein said each supporting member of said foot plate comprises a pair of slidable tubes that are pivotally affixed to said foot plate for providing support to said foot plate in an inclined position, wherein said pair of slidable tubes of each supporting member is adjustably connected through a locking pin.

18. The foldable hack squat and leg press machine of claim 16, wherein said one or more supporting struts include at least one of a gas strut, a gas spring, a gas piston and gas rams.

19. The foldable hack squat and leg press machine of claim 16, wherein said cushion pad is detachably positioned to said foot plate using one or more fasteners during the leg press exercise, wherein said fasteners include at least one of magnets, screws, bolts, nuts, and pins.

20. The foldable hack squat and leg press machine of claim 16, wherein said foldable hack squat and leg press machine is configured to support on one or more heavy-duty wheels, which are affixed to a bottom portion of said elongated frame, thereby allowing the user to easily move said foldable hack squat and leg press machine from one place to other, wherein said one or more heavy-duty wheels are locked by brake members when said foldable hack squat and leg press machine is used by the user during the hack squat and leg press exercises.

21. The foldable hack squat and leg press machine of claim 16, wherein said one or more hydraulic actuators are operably connected to side portions of said elongated frame to ensure proper movement for said shoulder engagement unit.

22. The foldable hack squat and leg press machine of claim 16, wherein said foldable hack squat and leg press machine further comprises:

a pair of holders configured to enable said user to hold said pair of holders during the leg press exercises.

23. A method for operating a foldable hack squat and leg press machine, comprising:

placing, by a user, said foldable hack squat and leg press machine by unfolding a supporting column of a foldable support unit;

adjusting, by the user, said supporting column to at least one selected angle of multiple angles and securely positioning an elongated frame;

positioning, by the user, a foot plate at an end portion of said elongated frame through supporting members;

adjusting, by the user, a shoulder engagement unit and a weight sled without or with required weights onto a shaft member of said weight sled, thereby allowing the user to perform a hack squat exercise;

detaching, by the user, a cushion pad from a backrest member of said shoulder engagement unit and positioning said cushion pad onto said foot plate using one or more fasteners;

moving, by the user, said backrest member from a folded position to an unfolded position and locking said backrest member in the unfolded position, thereby allowing the user to perform a leg press exercise; and folding, by the user, said backrest member, said foot plate, and said supporting column of said foldable support unit, thereby allowing the user to fold said foldable hack squat and leg press machine vertically into a compact form for storage when not in use and easily move said foldable hack squat and leg press machine from one place to other.

* * * * *